US005241703A

United States Patent [19]

Roberts et al.

[11] Patent Number: 5,241,703

[45] Date of Patent: Sep. 7, 1993

[54] PROTECTIVE SHIELD WITH A FOREARM SUPPORT

[76] Inventors: John C. Roberts, 7638 Mable Louis La., Orlando, Fla. 32817; William A. Elmer, 1010 Temple Grove, Winter Park, Fla. 32789

[21] Appl. No.: 820,115

[22] Filed: Jan. 13, 1992

[51] Int. Cl.[5] ..... F41H 5/06

[52] U.S. Cl. ..... 2/2; 2/2.5; 89/36.05; 109/49.5

[58] Field of Search ..... 2/1, 2, 2.5, 46, 92; 40/584, 586, 615; 89/36.05; 109/49.5; 224/218, 222, 267, 907

[56] References Cited

U.S. PATENT DOCUMENTS

| | | | |
|---|---|---|---|
| D. 132,468 | 5/1942 | Leuer | 89/36.05 X |
| 1,140,107 | 5/1915 | Brown | 2/16 X |
| 1,250,197 | 12/1917 | Louppe | 2/2.5 |
| 1,314,053 | 8/1919 | Eissler | 2/20 |
| 1,510,783 | 10/1924 | Johnson | 2/2 |
| 1,895,197 | 1/1933 | Martinson | 2/2.5 |
| 2,020,702 | 11/1935 | Russell | 2/2.5 |
| 2,316,055 | 4/1943 | Davey | 2/2.5 |
| 3,370,302 | 2/1968 | Karlyn | 2/2.5 |
| 3,911,497 | 10/1975 | Lewis, Jr. et al. | 2/16 |
| 3,924,272 | 12/1975 | Allen et al. | 2/16 |
| 4,062,073 | 12/1977 | Rhee | 2/16 |
| 4,190,902 | 4/1980 | Rhee | 2/16 |
| 4,198,708 | 4/1980 | Fugere et al. | 2/16 |
| 4,412,495 | 11/1983 | Sankar | 89/36.65 |
| 4,843,947 | 7/1989 | Bauer | 2/2.5 X |
| 5,056,155 | 10/1991 | Truxell | 2/2 |

*Primary Examiner*—Clifford D. Crowder
*Assistant Examiner*—Jeanette E. Chapman

[57] ABSTRACT

The protective shield includes an elongated transparent shield member and a molded forearm support member having a forearm concavity spaced from the shield member by a dimension which provides additional protection to the person using the protective shield.

11 Claims, 2 Drawing Sheets

FIG. 1
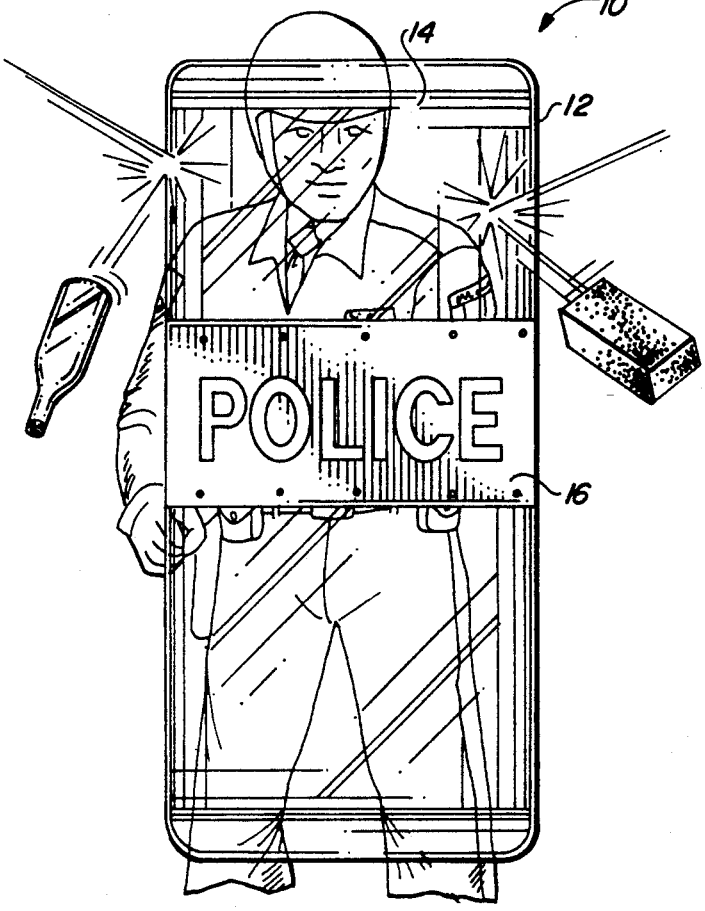
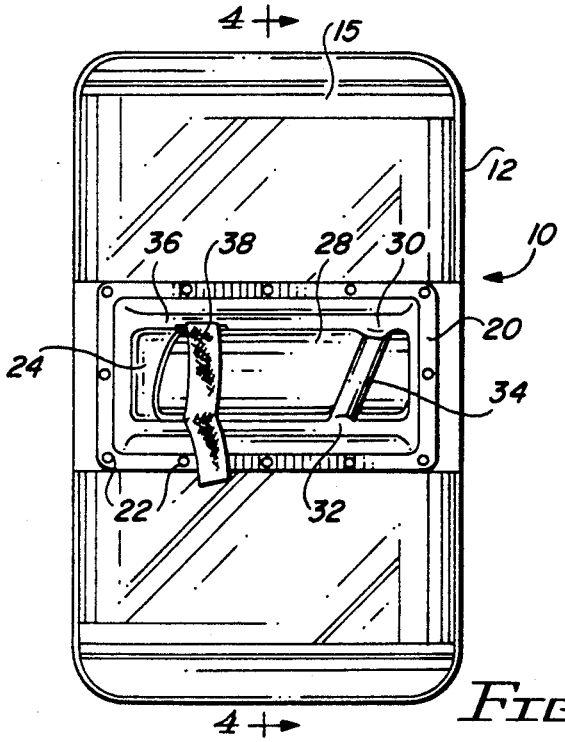
FIG. 2
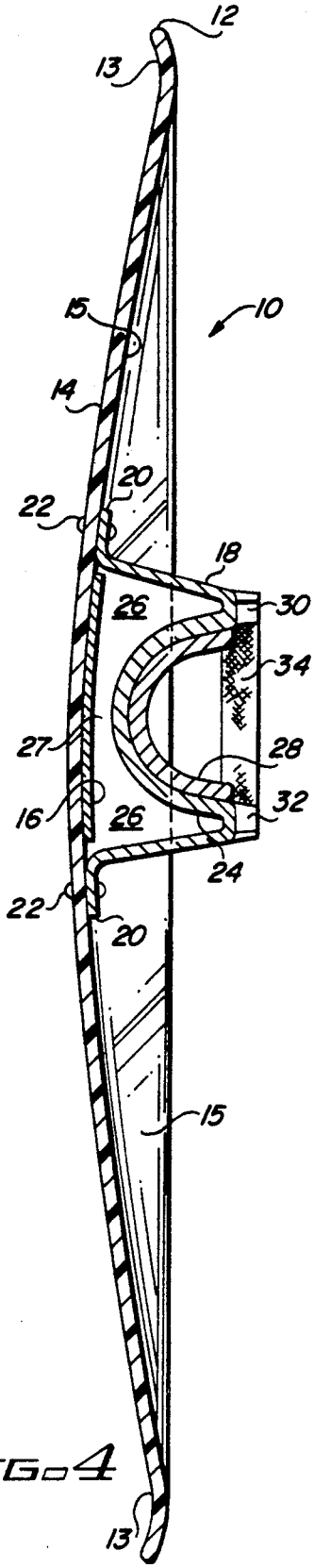
FIG. 4

PROTECTIVE SHIELD WITH A FOREARM SUPPORT

BACKGROUND OF THE INVENTION

1. Field of the Invention

The present invention relates to protective shields for the military, peace officers and the like, and to methods for making such shields.

2. Description of the Prior Art

Protective shields have been used in the past by law enforcement and military officers during riots and other violent confrontations, for protection from injury caused by thrown objects. A number of constructions for such protective shields have been described in the past. One example is disclosed by Karlyn in U.S. Pat. No. 3,370,302, and employs an elongated transparent and convex outer shield member, with a curved resilient cushion attached directly to the concave inside surface of the shield member.

Other shield constructions are taught in the following U.S. Pat. No. 2,316,055 to Davey, U.S. Pat. No. 3,745,938 to Hathaway et al; U.S. Pat. Nos. 5,056,155 to 1,510,783 to Johnson; U.S. Pat. No. 1,314,053 to Eissler; U.S. Pat. No. 1,250,197 to Louppe; and U.S. Pat. No. 1,140,107 to Brown. Other prior art of interest also includes French Patent 1,060,110.

SUMMARY OF THE INVENTION

The present invention contemplates a protective shield and a method for making it, which shield provides a significant degree of protection to the arm and body of the officer holding the shield during use. The shield includes a transparent shield member having an outer convex shield surface and an inner concave surface. The shield is provided with a forearm support member having a curved surface conforming and fixed with the inner surface of the shield member, and a relatively straight forearm support surface spaced from the curved surface, the inner surface and the forearm support surface defining an intermediate protective space between them. The shield also includes a hand grip fixed with the forearm support member.

In the preferred form of the protective shield in accordance with this invention, the forearm support member comprises a hollow unitary molded member having a peripheral flange which is attached to the inner surface of the transparent shield member, and a partially cylindrical forearm concavity which extends in a direction of elongation generally lateral to the direction of elongation of the transparent shield member. The forearm concavity is dimensioned to receive the forearm of the officer using the shield. It is also preferred that the hand grip be fixed to the forearm support and extend across the concavity at an angle on the order of between about 50°-80° with respect to direction of elongation of the forearm support. Suitably, the cylindrical forearm concavity is lined with a cushion pad, and an arm support strap is fixed at one end of the forearm concavity opposite the hand grip. The forearm support member has a sloping surface at one corner, to permit the upper arm of the officer using the shield to extend generally parallel with the transparent shield member.

The sides of the forearm support member which define the intermediate space between the peripheral flange of the support member and the forearm concavity permits the support member to act as a shock absorber for objects which strike the outer space of the transparent shield member. The intermediate space also holds the officer's forearm away from the inner concave surface of the shield member, thus further avoiding injuries from sharp objects that may extend through the transparent shield member (for example, a knife blade).

The method for making the protective shield includes, the step of providing the transparent shield member, and the further step of molding an elongated forearm support member so as to include a peripheral flange which is curved to conform to the curvature of the inner surface of the shield member in a direction generally lateral to the direction of elongation of the shield member. The forearm member also is molded to include a partially cylindrical forearm concavity along an outer surface thereof opposite the peripheral flange, with the forearm concavity extending generally parallel with the direction of the forearm support. Thereafter, the peripheral flange is attached to the inner surface of the transparent shield member with the flange conforming to the inner surface thereof.

These and other features of the transparent shield and method of the present invention will be understood wit reference to the drawings, described next.

THE DRAWINGS

FIG. 1 is a front view of a transparent shield in accordance with the present invention.

FIG. 2 is a rear view of protective shield of the present invention.

FIG. 4 is a cross sectional side view of the protective shield of FIG. 2, taken along the lines 4—4.

DETAILED DESCRIPTION

Figure 3:
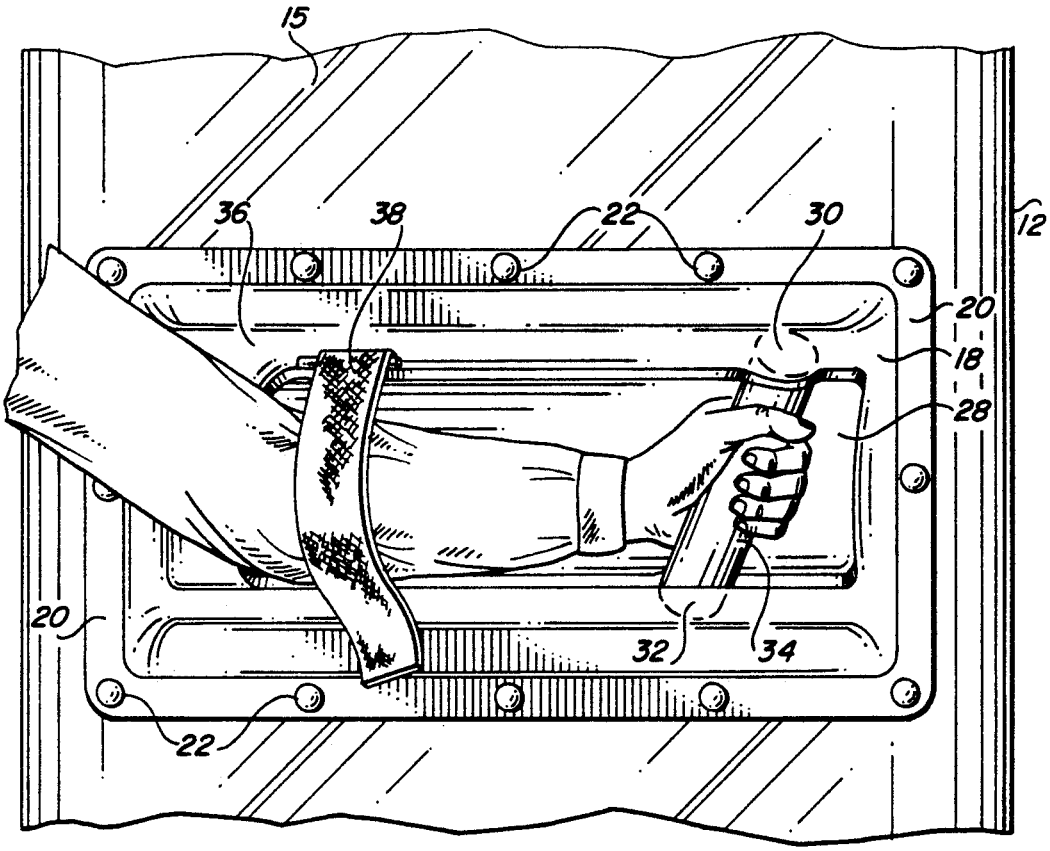
FIG. 3 is a rear view like FIG. 2, partially broken away, and illustrating the use of the protective shield.

The protective shield and the method for making same will now be described with reference to FIGS. 1 through 5, where the protective shield is referred to generally by the reference numeral 10.

The protective shield 10 includes a transparent shield member 12 which is elongated in the vertical direction, and which has a convex curved outer surface 14 and a corresponding concave inner surface 15. A message sheet 16 is affixed to the inner surface 15 of the shield member 12, and is protected by the forearm support member 18, described below. The transparent shield member is typically molded from a sheet of LEXAN or other polyresin material of similar strength, and may include a curved periphery 13.

The forearm support member 18 is molded as a hollow, unitary member having a peripheral flange 20 which is attached to the inner surface 15 of the shield member 12 by fasteners 22. The forearm support member 18 further includes a partially cylindrical concavity 24 dimensioned to receive a forearm of the person using the shield 10, as shown in FIG. 3; the forearm concavity 24 extends generally parallel with the direction of elongation of the forearm support 18 and generally lateral to the direction of elongation of the shield member 12. As shown in FIG. 4, the forearm member 18 is molded so as to define a void 26 between the peripheral flange and the upper extremity of the support member 18, and a space 27 between the lower extremity of the concavity 24 and the inner surface 15 of the transparent shield member 12. Molded ribs 25 along the periphery of the forearm concavity 24 add structural strength. It is also preferred that the forearm support member 18 be molded of a transparent high-strength polyresin, such as LEXAN.

Figure 5:
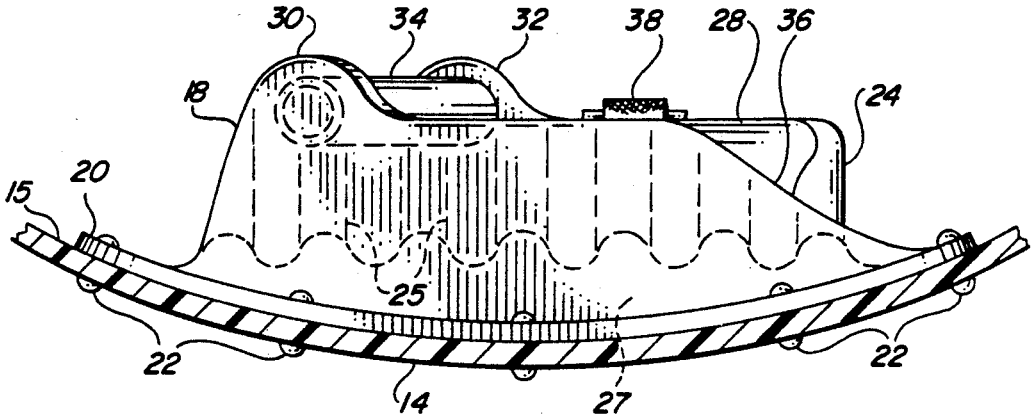
FIG. 5 is a top view of the protective shield shown in FIGS. 1-4, with a portion of the transparent shield member broken away.

A cushion layer 28 is positioned about the inner periphery of the forearm concavity 24. A pair of molded risers 30, 32 have opposing holes to receive a hand grip 34. As shown in FIGS. 2, 3 and 5, the hand grip extends at an angular relationship of between about 50°-80° with respect to the lateral direction of the forearm concavity 24. In order to permit the upper arm of the officer using the protective shield 10 to extend in a direction which permits easy access of the forearm across the forearm support (see FIG. 3), the forearm support member 18 also includes a sloping surface 36 at the end opposite the hand grip 34. A strap 38 is positioned along the top of the molded forearm support member 18.

The transparent shield 10 is fabricated by first molding the elongated transparent shield member 12 to define the outer convex shield surface 14 and the inner concave surface 15. The forearm support member 18 is molded to define the hollow space 26 and the dimension 27 between the bottom of the forearm concavity 24 and the peripheral flange 20, and with the peripheral flange curved to conform to the curvature of the inner surface 15 in a direction generally lateral to the direction of elongation of the shield member 12. The forearm support member 18 is also molded to include the partially cylindrical forearm concavity 24 along the outer surface thereof opposite the peripheral flange 20, with the forearm concavity 24 extending generally parallel with the direction of elongation of the forearm support member 18. It will also be understood that the handle risers 30 and 32 are integrally formed with the forearm support member 18 during the molding operation, with holes being provided on the inside surfaces of the risers 30, 32 for insertion of the handle 34.

This concludes the description of the preferred embodiments. A reading by those skilled in the art will bring to mind various changes without departing from the spirit and scope of the invention. It is intended, however, that the invention only be limited by the following appended claims.

What is claimed is:

1. A protective shield comprising:

an elongated transparent shield member having an outer convex shield surface and an inner concave surface;

a forearm support member having a curved surface conforming and fixed with the inner concave surface, the forearm support member further including a relatively straight forearm support surface defining a partially cylindrical concavity generally conforming to the shape of a forearm of a person and extending generally lateral to the direction of elongation of the shield member, and spaced from the curved surface, the inner surface and the forearm support surface defining an intermediate space between them; and a hand grip fixed across the forearm concavity at one end thereof, the hand grip extending at an angle on the order of between 50°-80° with respect to the axial direction of the forearm concavity.

2. The protective shield recited in claim 1 wherein the forearm support member comprises a unitary plastic transparent molded member.

3. The protective shield recited in claim 2 wherein the unitary molded forearm support member includes a peripheral flange curved to conform with the inner concave surface of the transparent shield member, with the intermediate space between the peripheral flange and the forearm concavity.

4. The protective shield recited in claim 1 further comprising a padding material attached about the inside of the forearm concavity.

5. The protective shield recited in claim 4 further comprising an adjustable strap along the forearm support member opposite the hand grip.

6. A protective shield comprising:

a transparent shield member having an outer convex shield surface and an inner concave surface;

a forearm support member having a curved surface conforming and fixed with the inner concave surface, the forearm support member further including a relatively straight forearm support surface spaced from the curved surface, the inner surface and the forearm support surface defining an intermediate space between them;

a hand grip fixed with the forearm support member; and a message sheet attached to the inner surface of the transparent shield member, and inside the forearm support member.

7. A protective shield, comprising:

an elongated transparent shield member having an outer shield surface and an inner surface;

an elongated forearm support having a direction of elongation extending generally lateral to the direction o elongation of the shield member, the forearm support comprising a hollow unitary molded member including a peripheral flange attached to the inner surface of the transparent shield member and a partially cylindrical concavity spaced from the peripheral flange and dimensioned to receive a forearm of a person, the forearm concavity extending generally parallel with the direction of elongation of the forearm support and generally lateral to the direction of elongation of the transparent shield member; and means for supporting a person's forearm in the forearm concavity.

8. The protective shield recited in claim 7 further comprising a hand grip fixed to the forearm support member and extending across the forearm concavity at an angle on the order of 50°-80° with respect to the direction of elongation of the forearm support.

9. The protective shield recited in claim 7 wherein the peripheral flange is attached to the inner surface of the transparent shield member by fasteners.

10. The apparatus recited in claim 7 wherein the molded forearm support member is transparent.

11. The protective shield recited in claim 7, wherein the molded forearm support member includes a sloping surface dimensioned to receive an upper arm of the person whose forearm is supported in the forearm concavity.

* * * * *